US005772047A

United States Patent [19]

Bostjancic

[11] Patent Number: 5,772,047

[45] Date of Patent: Jun. 30, 1998

[54] STATIONARY SERVICE BENCH WITH TOOL PANEL

[75] Inventor: Paul Bostjancic, Chicago, Ill.

[73] Assignee: Ready Metal Manufacturing Company, Chicago, Ill.

[21] Appl. No.: 639,130

[22] Filed: Apr. 26, 1996

[51] Int. Cl.[6] ..... A47F 5/00

[52] U.S. Cl. ..... 211/13.1; 211/70.6; 211/59.1; 312/902

[58] Field of Search ..... 211/13.1, 70.6, 211/85.8, 133.1, 133.3, 59.1; 312/902; 248/176.1, 127

[56] References Cited

U.S. PATENT DOCUMENTS

| | | | |
|---|---|---|---|
| D. 272,111 | 1/1984 | Anzalone . | |
| D. 348,960 | 7/1994 | McCaffrey . | |
| 1,801,453 | 4/1931 | Patterson | 211/70.6 X |
| 3,677,415 | 7/1972 | Radek . | |
| 4,122,956 | 10/1978 | Hargrove . | |
| 4,669,173 | 6/1987 | Chancy, Sr. . | |
| 4,681,233 | 7/1987 | Roth . | |
| 4,715,573 | 12/1987 | Liegel . | |
| 5,083,669 | 1/1992 | Wischart | 211/70.6 |
| 5,113,920 | 5/1992 | Sedeniussen . | |
| 5,116,264 | 5/1992 | Wiederrich et al. . | |
| 5,141,211 | 8/1992 | Adams, Jr. . | |
| 5,152,441 | 10/1992 | Corena | 312/902 X |
| 5,332,305 | 7/1994 | Slivon et al. . | |
| 5,346,167 | 9/1994 | Smialek . | |
| 5,588,659 | 12/1996 | Boes et al. | 211/70.6 X |

*Primary Examiner*—Robert W. Gibson, Jr.
*Attorney, Agent, or Firm*—Dvorak & Orum

[57] ABSTRACT

A stationary and vertically positionable service bench includes a stand that is mounted to the floor of a servicing area, wherein the stand supports an upstanding pegboard display panel and a horizontal servicing shelf. The display panel also supports a high pressure air supply conduit which provides several releasable quick connect/disconnects for powering pneumatic tools. The display panel bottom includes a tray for holding spare parts and small hand tools, wherein the upper part of the panel receives various pegboard hooks for holding and displaying tools used by a service technician.

12 Claims, 3 Drawing Sheets

STATIONARY SERVICE BENCH WITH TOOL PANEL

BACKGROUND OF THE INVENTION

1. Field of the Invention

The present invention relates generally to a stationary service bench and more particularly to a work bench utilized in the tire repair servicing business. The service bench includes a tool-carrying panel or pallet disposable in an upright display position for supporting various wrenches, pneumatically-operated tools, and parts trays. The service bench of the present invention also includes a shelf for servicing the tires such that specialized tools and other job-related accessories are always positioned within arm's reach of a service technician working at said bench.

2. Description of the Prior Art

Presently, service technicians are limited to either basic or very particularized devices for positioning and supporting tools and test equipment while performing maintenance and repairs on tires. The need for a service bench at the specific job location has heretofore been reenforced by the inconveniences to the service technician in procuring tools and hardware from various storage places around the work area, as well as the time wasted in doing so. Furthermore, in the repair or installation of tires, and the preparation of the wheels, or rims, many types of pneumatic tools must be utilized, thereby requiring serveral air hoses to be strewn across or around the work area. This creates a potential tripping hazzard that could result in serious injury to the worker or even damage to the work tools when repeatedly setting the tools on the floor.

Other outdated prior art devices such as mobile storage carts, roll-around maintenance carts, and roll-around tool storage chests are extremely limited in function, and in all known cases, these devices will transport tools and equipment to the job location, but only in a fixed position, configuration, and height.

In addition to the problems presented above, as well as the time consumed in procuring job-related tools, additional inconveniences are encountered in handling the hardware items associated with repairing the tire or installing new ones. For example, many lug nuts and bolts, as well as valve stems, valve plugs, etc., are required to be removed from the tire during removal from the car or replaced on the tire and rim during change-out of the tire. The necessity for maintaining an accounting of the hardware items for the tire and rim is well known. However, it has heretofore been the case that a separate container is usually obtained by the service technician to hold the above-mentioned hardware items, which container must oftentimes be placed on the floor proximate to the work area or on an adjacent work bench. In either case, when a multitude of hardware items are to be handled, it is inconvenient for the service technician to properly sort all hardware items into their proper separate container. If the service technician is attentive to the sorting and accounting of the hardware items in this manner, the repair job being done will likely take a much longer time to complete.

Accordingly, it would be desirable to have a service bench with a tool panel for holding both job-related tools and hardware that could be positioned within the immediate work area of the car being serviced, and permit the service technican quick and ready access to the necessary tools and hardware in an expeditious manner, without the fear of tripping or slipping on tools, air hoses, or hardware.

SUMMARY OF THE INVENTION

The present invention is directed to a stationary service bench apparatus that not only saves time and provides for more efficient work possibilities for a service technician, but also provides a centralized tool and hardware center, wherein the work area is kept free from the above-mentioned hazards by eliminating the necessity for air hoses to be strewn across and throughout the work place, and where efficiency is maximized by providing several specific storage bins for hardware, tool holders for specialized wrenches, pneumatic air tools, etc., so that the service technician does not have to leave his work area in search of those items.

It is another object of the present invention to provide a positionable service bench that can be adjusted according to the physical requirements of each service technician.

It is another object of the present invention to provide a vertically disposed display panel in the form of a pegboard for displaying and holding specifically used tools and wrenches pertaining to the servicing of an automobile tire.

It is another object of the present invention to provide a positionable service bench with a tool-holding surface according to the specific working requirements of each service technician.

It is another object of the present invention to provide a stationary service bench with positionable shelf and an upright pegboard display panel that maintains only the necessary tools for a specific job within the reach of the user-technician to thereby increase productivity and reduce user fatigue by eliminating repetitious trips to obtain and replace different tools and hardware related to the servicing of the tire.

According to the present invention, the foregoing and additional objects are attained by providing a positionable service bench having a vertically orientated display pegboard rack which will facilitate the storage and display of necessary tools related to the servicing of an automobile. A horizontally disposed shelf is positioned below the display panel in order to provide a convenient work bench top readily accessible within the service technician's work area for servicing related work, as well as serving as a desk top for completing necessary paperwork.

More particularly, the present invention includes a vertical stand or post for supporting the vertically arranged pegboard display panel and the horizontally disposed work bench shelf. In one embodiment of the present invention, the vertical display panel incorporates several different types of tool-holding clips or hooks so that pneumatic air tools as well as various types of wrenches, hammers, screwdrivers, etc., can be held against the pegboard in proper storage and display until required for use. Disposed along the bottom of the pegboard display panel is a tray which contains multiple, separated compartments for storing the specifically-needed hardware related to the servicing of an automobile tire and rim. In a second embodiment, the lower portion of the service bench is provided a frame assembly which is adapted to support several tiers of removable wire baskets or drawers. Depending upon the specific requirements at each job location, drawers or baskets can be added or removed as desired.

BRIEF DESCRIPTION OF THE DRAWINGS

A more complete appreciation of the present invention and many of the attendant advantages thereof will be more readily apparent as the same becomes better understood by reference to the following detailed description when considered in reference to the accompanying drawings wherein.

DETAILED DESCRIPTION

Figure 1:
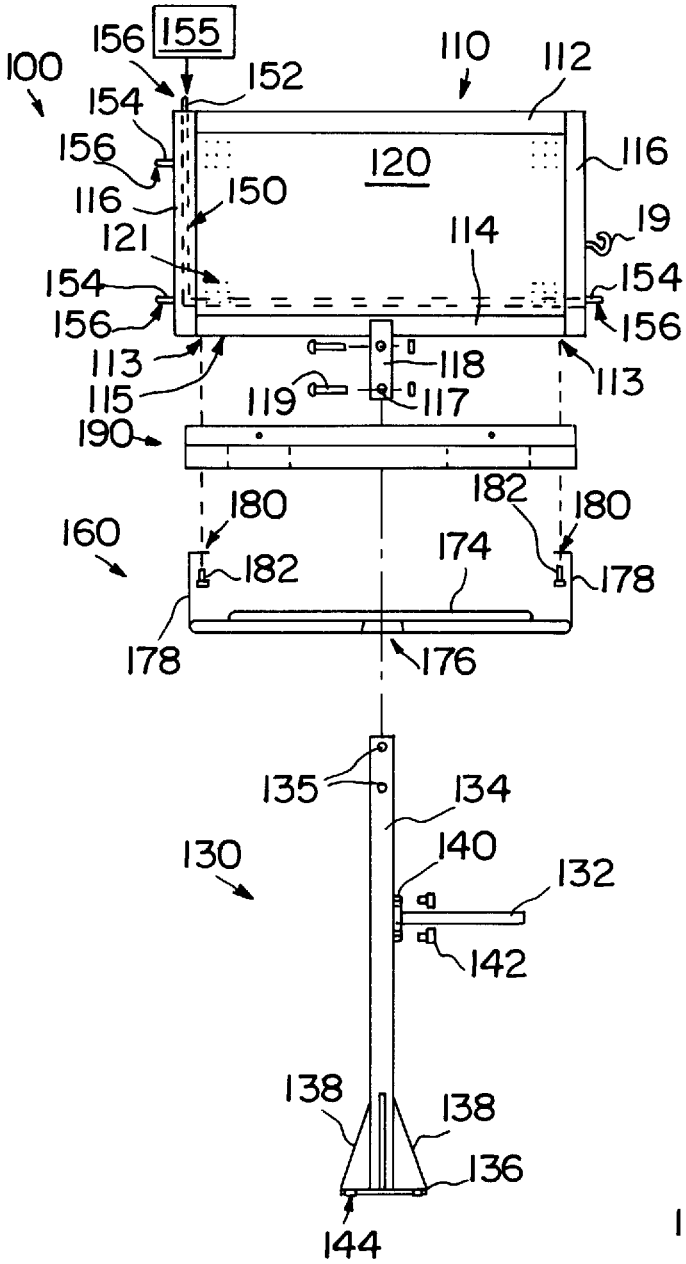
FIG. 1 is a front view of the stationary service bench according to the present invention.

Referring now to the drawings and particularly FIGS. 1–1D, the preferred embodiment of the stationary service bench of the present invention is shown, and will now be generally designated by reference numeral 100. As seen, stationary service bench 100 includes the major features of the following components; a vertically upright 130, which supports a frame 110. Frame 110 on the other hand retains a typical pegboard or pallet 120, a tray 190 attached to said pegboard, and a horizontally disposed work shelf 160.

As FIG. 1 shows, the upright stand 130 is comprised of a vertically arranged open post 134 which is attached to a tieplate 136 preferably by welding or other conventional means wherein the provided holes 144 in the tieplate 136 are used for securing the entire bench 100 in a stationary, fixed position to a service area floor. Gussets 138 are provided at the bottom portion of post 134 in order to interconnect tieplate 136 and post 134, thereby strengthening service bench 100 against any form of swaying or lateral instability. Post 134 is preferably made from square channel or seamless tube that includes smoothly drilled holes 135 at its top portion for pinning post 134 to frame 110 via connecting pins or bolt-and-nut assemblies 119, as will be described in greater detail shortly. It is also seen that post 134 includes a fender cover bar 132 for covering the fender of an automobile. Fender cover bar 132 is vertically positionable by sliding base plate 140 to the desired vertical height from the service floor and then aligning the drill holes in base plate 140 (not shown) for the hose in post 134 so that common bolts 142 can be used to secure cover bar 132 to post 134. Since post 134 is preferably made from square stock material, channel plate 140 will be in fully abutting contact with post 134.

As previously mentioned, frame 110 is connected to post 134 through a stand connector 118, wherein connector 118 is first inserted through a shelf throughbore 176 and then slidably inserted inside the open cavity of post 134. The stand connector 118 includes the vertically aligned holes 117 which are in horizontal alignment with holes 135 on post 134 when frame 110 is inserted within upright stand 130. Securing means 119 are then inserted through aligned holes 117 and 135 and can include either nut-and-bolt arrangements, or cleavice pin arrangements.

Figure 1A:
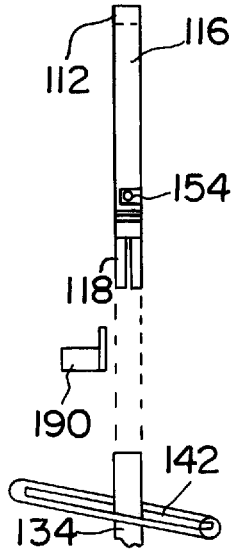
FIG. 1A is a side view detailing the frame and the frame connector post.
Figure 1B:
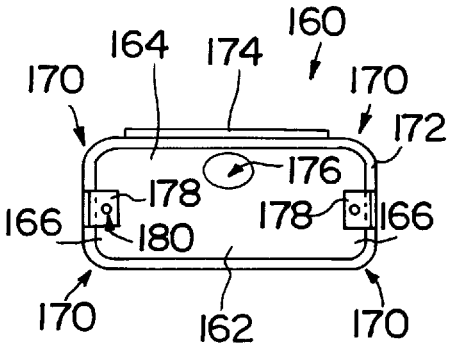
FIG. 1B is a top view showing the shelf which is used with the present invention.
Figure 1C:
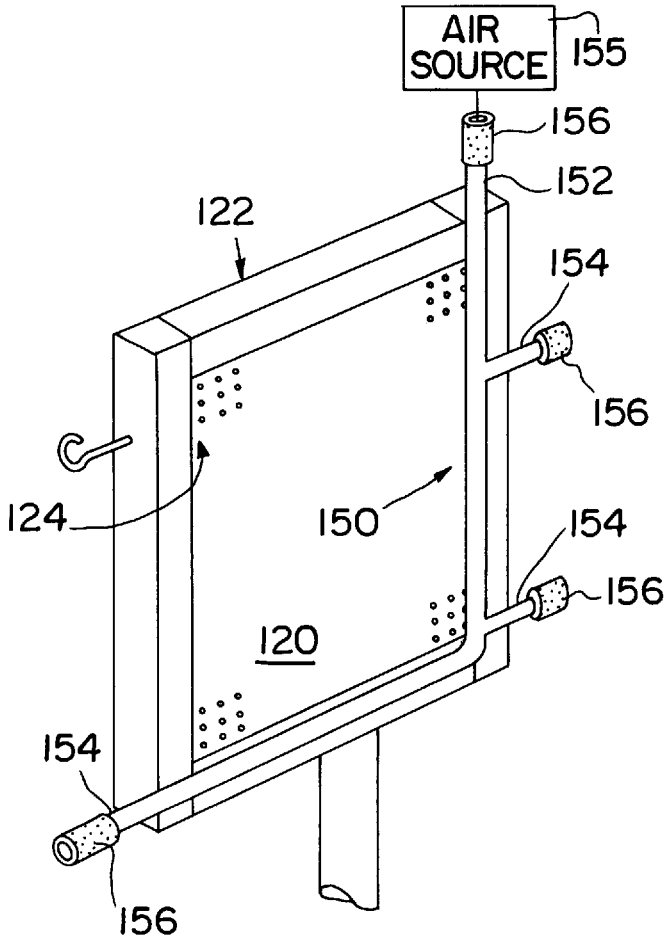
FIG. 1C is a perspective view showing the rear side of only the frame and air system of the present invention.

FIGS. 1, 1A, and 1C provide greater detail in describing frame 110 wherein it is seen that said frame includes a top member 112, a bottom member 114, and interconnecting side members 116, thereby preferably forming a general rectangularly shaped frame. The frame 110 is preferably made from a smaller size square channel and is typically connected together by welding. As the Figures show, a perforated panel member or pallet 120, is retained by frame member 110 such that it is in an upstanding position. FIG. 1 shows that panel 120 is uniformly covered with perforations 121 which extend from front face 122 through rear face 124. This panel member is typically a common piece of pegboard. The pegboard panel 120 conveniently allows the service technician to pick and choose a multitude of various and commonly available clip-on pegboard hooks and holders such that only the required tools for servicing an automobile tire are pinned and displayed against pegboard 120. In this way, a service technician can readily keep close track on tools so that the chance of misplacing or loosing the tools is minimized. Furthermore, the use of the pegboard allows the service technician a convenient location for placing his tools, rather than setting them on the workpiece or on the service area floor, thereby avoiding the creation of either a slipping or tripping hazard. It is also important to locate the stand connector 118 at the longitudinal midpoint of bottom member 114, otherwise instability will be introduced to the service bench 100.

Turning attention now to FIG. 1C, it is seen that the rear face and the back side of frame 110 are shown in greater detail. Rear face 124 of pegboard 120 is used for securing the air supply conduit 150. Air supply 150 is generally a pressurized air header system which is used for providing various drop locations for feeding pneumatic air wrenches, air drills, and other air tools. As this Figure shows, a high pressure air source 155 is preferably located above frame 110 such that a high pressure supply of air can be connected to an inlet port 152 either via a quick disconnect 156 or it can even be connected through commonly known hardpiping methods. In the preferred embodiment, a multitude of outlet ports 154 are provided so that the service technician can have several pneumatically-operated air tools connected to service bench 100 without the need for connecting and disconnecting a particular pneumatic tool, as demand requires. The quick disconnects 156 are well known and are provided at the ends of each outlet port 154 and project beyond the vertical side members 116 of frame 110. The air supply conduit 150 can be attached to pegboard 120 simply by using U-shaped brackets and nuts (not shown). One very important and advantageous feature of providing air supply conduit 150 directly to service bench 100, is that the elimination of air hoses on the service area floor will virtually eliminate the possibility of the service technician to slip or trip on an air hose, since air tools and hoses are no longer strewn on the service area floor. Therefore, it can be appreciated that after a particular pneumatic air tool is used, it is typically hung against frame 110 by providing various holders 196 or 198 (See FIG. 2) and since the length of the air hose is not very long, there are virtually no hoses touching the service area floor. In contrast, typical prior art work benches would require a considerable length of hose to be run from an air source somewhere downstream, thereby creating a cluttered, potentially dangerous work area for the service technician.

Figure 2:
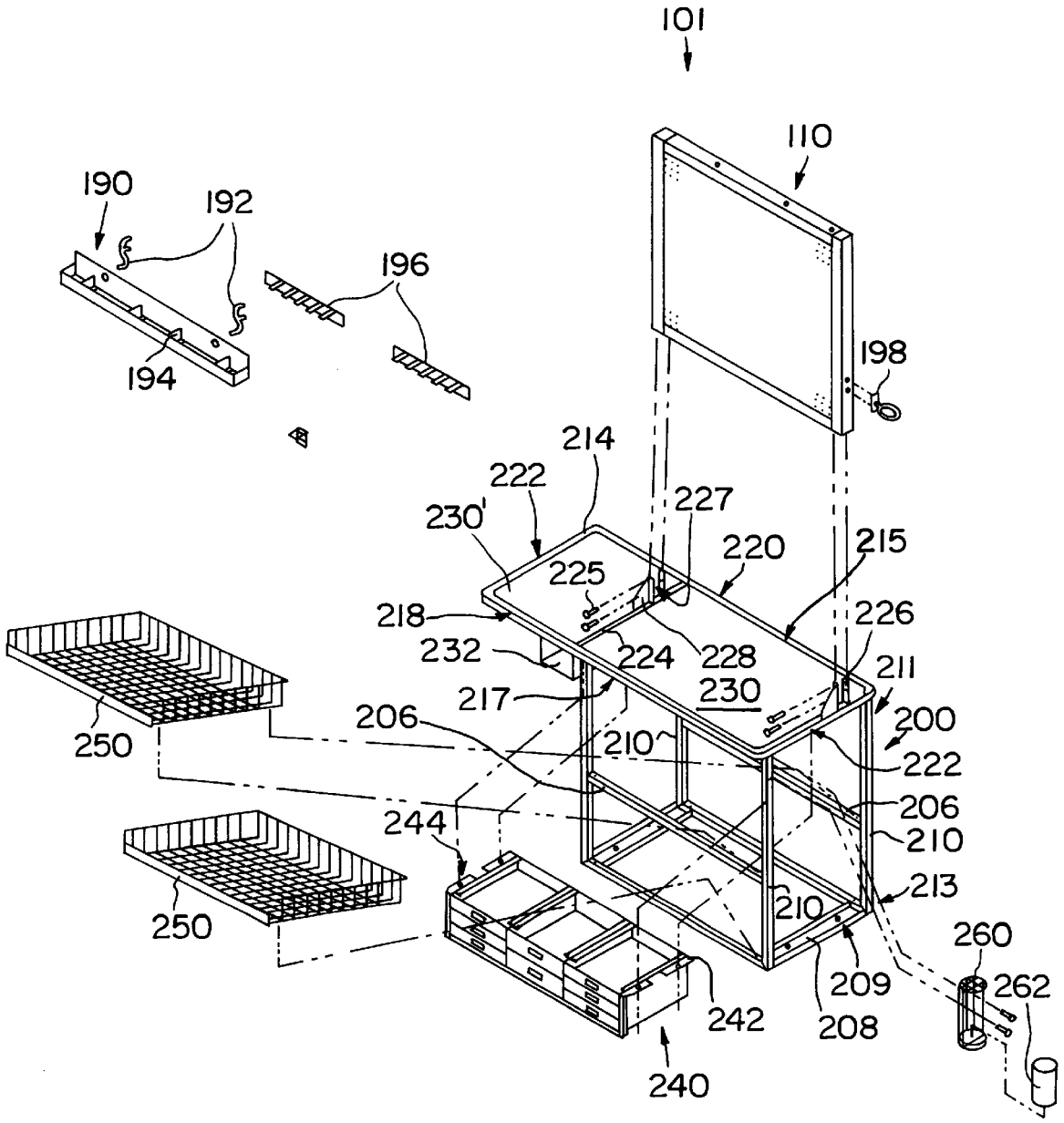
FIG. 2 is a exploded perspective view showing the second embodiment of the present invention.

Another advantageous feature of the present invention is that a tool or hardware parts tray 190 can be readily attached to pegboard 120 along bottom member 114 in order to provide a neat and convenient storage system for the service technician. FIG. 2 shows a perspective view of the envisioned tool or hardware tray 190 wherein separators 194 can be removably adjusted to create varying sizes of storage bins within tray 190. As FIG. 2 also shows, tray 190 contains at least two holes 193 for receiving hook-shaped pegboard brackets 192 which connect with perforations 121 on pegboard 120, thereby supporting tray 190. A similar arrangement would also be envisioned for the apparatus of FIG. 1.

Focusing attention on FIGS. 1, 1A, and 1B, the first embodiment of service bench 100 is shown to include the servicing shelf 160. Shelf 160 is horizontally disposed and is provided with a front side 162, a back side 164, interconnecting opposing sides 166 which define an overall shelf perimeter 168 (not shown, but implied), and corners 170.

FIG. 1B shows that corners 170 are preferably rounded in order to prevent a contacting injury against a sharp edge. FIG. 1B also shows that a centrally located shelf hole 176 is contained therein so that shelf 160 can be inserted over upright stand 130, as previously mentioned. Shelf 160 is attached to the bottom member 114 of frame 110 through upstanding brackets 178. FIG. 1 best illustrates that said brackets are generally L-shaped and commonly made from flat stock so that one end can be attached to shelf 160 by welding, or other convenient attaching means, while the opposite end is attached to bottom side 115 by aligning holes 113 provided in bottom member 114 with holes 180 provided in brackets 178 and then securing the two members together in abutting contact with bolts 182. Brackets 178 are sufficiently long to ensure that shelf 160 is vertically disposed a distance below tray 190 in order to provide proper clearance for any tire or other workpiece a service technician may bring to shelf 160.

In order to prevent the inconvenience of various small tools and hardware parts either rolling or being knocked off shelf 160, a guard 172 is provided around the perimeter 168 of the shelf. The guard 172 is rather insubstantial so that it does not interfere with the ability of the service technician to work on whatever workpiece he has positioned on shelf 160. It is seen that shelf 160 also contains the upstanding flange 174 mounted on the back side member 164 in order to provide a backstop for an automobile tire or whatever piece of equipment a service technician is servicing.

Turning attention now to FIG. 2, a second embodiment of the present invention is shown at 101. In order to provide much greater storage capacity to service bench 100, a larger frame assembly 200 is provided so that a series of wire baskets 250, as well as multiple cabinet assemblies 240 can be used for storage of either frequently used hardware parts, paperwork, or tools. In addition, this particular embodiment provides a substantially larger work bench area in the form of the horizontally-disposed shelf 230, as well as the optional shelf overhang 230'.

The frame assembly 200 is provided with upright legs 210 attached to transverse members 206 and lateral members 208 in order to provide a base for the shelf support member 214. The upright legs 210 have a top portion 211 and a bottom portion 213 wherein each of the leg top portions are suitably connected to shelf support member 214 by welding, while leg bottom portions 213 are welded to the transverse and lateral members 206, 208. In this way, anchoring holes 209 can be provided in lateral member 208 for securing service bench 101 to the work area floor. The transverse members 206 function not only to strengthen service bench 101 against twisting deformations, but they also provide a convenient member for attaching either wire basket members 250 or cabinet assembly 240 thereto. As mentioned, a shelf support member 214 is attached to each of the upright legs so that a horizontal work station shelf can be provided to the service technician. The shelf support member 214 is comprised of a front member 218, a back member 220, and interconnecting side members 222 as well as a strengthening post 224. As FIG. 2 shows, the shelf support member is generally of a rectangularly shaped configuration retaining shelf 230 and shelf overhang 230'. The shelf and shelf overhang can be made out of any desired choice of materials ranging from steel plate, to wood, or even the composite material known to cabinet makers under the brand name of Correon™. The top side 215 of support member 214 also includes a pair of upstanding, U-shaped brackets 226. One bracket is shown being attached to strengthening post 224, although if desirable, both brackets can be located on each of the side members 222, such that frame 110 is enlarged. With either choice, the upstanding flanges will define a frame receiving cavity 227 wherein frame 110 is inserted therein and then rigidly coupled to brackets 226 by drilling appropriate holes in the frame 110 and through each of the upstanding posts defining the U-shaped bracket. Bolts 225 and nuts (not shown) are used to removably attach frame 110 to frame assembly 200. In order to strengthen brackets 226, a respective pair of gussets 228 are attached to each post comprising the legs of the U-shaped bracket. It should also be understood that brackets 226 will be located near the back member 220 of shelf support member 214, in order to provide a larger work area on the shelf 230. An optional box 232 can be provided on the optional overhang 230', wherein said box extends the distance between front member 218 and back member 220. It is envisioned that this box be used for rags or paper towels, although it would be a matter of choice as to exactly how the service technician would use this additional storage space. It is also noteworthy to point out that the cabinet assembly 240 includes lateral side flanges 242 and holes 244 that respectively attach the front and back of the cabinet assembly to the bottom side 217 of respective members 218 and 220. It is envisioned that self-tapping screws can be used to secure the cabinet flanges to the shelf support front and back members once the appropriate holes are drilled. A tool tray 190, as used in the first embodiment, can also be hung against the pegboard panel 120 through the use of hook-shaped brackets 192 in order to provide additional storage space for frequently-used hardware and/or tools. In addition, various tool-holding pegboard brackets 196 can also be used with this embodiment, as with previous embodiments, for providing a neatly organized and safe workplace as previously mentioned. Different types of pegboard holders can be attached along the frame assembly 200 in order to provide whatever convenience the service technician may demand. For example, FIG. 2 shows a wire cup holder 260 with a cup 262 for holding the service technician's coffee cup or soft drink can. As before, an air-operated wench or drill-holding bracket 198 can be attached to frame 110 in order to keep the work area tidy and free from air hoses. And, as previously explained, frame 110 and air supply conduit 150 will function exactly as explained earlier. Therefore, no detailed description on that member will be provided with this particular embodiment.

Other variations and modifications of the described invention may be readily apparent to those skilled in the art in the light of the above teachings, and it is to be understood that, within the scope of the appended claims, the invention may be practiced other than as specifically described herein.

What is claimed as new and desired to be secured by Letters Patent of the United States is found below.

I claim:

1. An automotive tire repair tool station mountable to a floor of a servicing area, comprising:

a frame;

a substantially upright panel retained by said frame, said panel having multiple perforations for receiving different kinds of tool holders for holding a service technician's tools, said frame comprised of a top member, a bottom member and interconnecting side members, said bottom member having a bottom side;

a pressurized air supply conduit located on at least one side of said frame, said conduit having an inlet port and at least one outlet port and being supported by the frame;

a horizontally disposed shelf formed by a front portion, a back portion, and opposing side portions wherein said front and back portions interconnect with said side sections to form rounded corners and to define a shelf perimeter, said shelf having an upwardly extending bracket on opposing side portions, and a vertically directed hole centered between said brackets, said brackets mountable to said bottom member of said frame wherein said shelf is supported below said frame; and an upright stand fixedly mountable on said floor, said stand extending through said hole in said shelf and coupled to said bottom of said frame.

2. The tool station of claim 1 wherein said frame encompasses said perforated panel, said frame having a stand connector disposed on said bottom portion thereof for rigidly connecting said frame to said upright stand.

3. The tool station of claim 2 wherein said shelf is substantially rectangularly shaped with a guard disposed about said perimeter and an upstanding flange disposed along said back portion thereof, said brackets arranged to support said shelf so that said back portion is vertically displaced lower than said front portion when mounted to said frame.

4. The tool station of claim 1 further comprising a tool tray with at least one hook-shaped bracket assembly for engaging said perforations on said perforated panel and supporting said tray.

5. The tool station of claim 1 wherein said upright stand is a post mounted on top of a horizontally disposed tie plate, said post and tie plate connected together by a plurality of upstanding gussets, said gussets for supporting said upright stand wherein said tie plate is mountable to said floor, said upright stand further including a horizontally extending fender cover bar protruding from said post, said cover bar supporting a fender cover that protects an automobile fender area.

6. The tool station of claim 1 wherein said at least one output port of said air supply conduit includes a releasable coupling for readily connecting and disconnecting a matable connector thereon.

7. The tool station of claim 6 wherein said inlet port is attached to a high pressure source of air.

8. An automotive tool station mountable to a floor of a servicing area, comprising:

a frame;

a substantially upright, and perforated panel retained by said frame, said perforations for receiving various kinds of tools holders for holding a service technician's tools;

a pressurized air supply conduit with an inlet port and at least one outlet port, said conduit supported by said frame; and a lower frame assembly fixedly mountable on said floor, said lower frame assembly including a shelf support member for receiving a horizontally disposed shelf and a pair of upwardly extending brackets for receiving a bottom portion of said frame which retains said perforated panel.

9. The tool station of claim 8 wherein said lower frame assembly comprises a plurality of upright legs each having a top portion and a bottom portion, said top portion of each said leg attached to said bottom side of said shelf frame and said bottom portion attached to at least one transverse member which is fixedly mountable to said floor, said upwardly extending brackets including upstanding gussets mounted between said shelf frame and said bracket.

10. The tool station of claim 9 wherein said at least one output port includes a releasable coupling for readily connecting and disconnecting a matable connector thereon.

11. The tool station of claim 10 wherein the frame is of a substantially rectangular shape which encompasses said perforated panel, wherein a tool tray with at least one hook-shaped bracket assembly engages said perforations on said perforated panel and supports said tray.

12. The tool station of claim 11 wherein the lower frame assembly further comprises a cabinet assembly of drawings mounted to said bottom side of the shelf frame and at least one wire bracket mounted below said cabinet assembly.

* * * * *